US005502842A

United States Patent [19]

Wagner

[11] Patent Number: 5,502,842

[45] Date of Patent: Apr. 2, 1996

[54] INFANT SWIMWEAR WITH INFLATABLE WAIST AND LEG PORTIONS

[76] Inventor: Sherry S. Wagner, 1913 Spruce, Higginsville, Mo. 64037

[21] Appl. No.: 338,240

[22] Filed: Nov. 14, 1994

[51] Int. Cl.[6] ..... A41D 7/00; A63B 31/00

[52] U.S. Cl. ..... 2/67; 441/120

[58] Field of Search ..... 2/67; 441/88, 102, 441/106, 108, 109, 110, 111, 113, 120, 129, 131

[56] References Cited

U.S. PATENT DOCUMENTS

| | | | |
|---|---|---|---|
| 1,268,179 | 6/1918 | Swanson | 441/88 |
| 1,657,467 | 1/1928 | Gates | 441/110 |
| 1,720,629 | 7/1929 | Dreyfus | 2/67 X |
| 2,197,228 | 4/1940 | Then | 441/102 |
| 2,888,691 | 6/1959 | Manning | 441/109 |
| 3,050,752 | 8/1962 | Birchall | 441/102 |
| 3,604,422 | 9/1971 | Sabee | 128/287 |
| 3,865,111 | 2/1975 | Brooks | 128/287 |
| 4,425,128 | 1/1984 | Motomura | 604/381 |
| 4,585,447 | 4/1986 | Karami | 604/385 A |
| 4,619,622 | 10/1986 | McDonald et al. | 441/111 |
| 4,643,728 | 2/1987 | Karami | 604/385 A |

FOREIGN PATENT DOCUMENTS

| | | | |
|---|---|---|---|
| 212169 | 3/1924 | United Kingdom | 441/120 |

*Primary Examiner*—C. D. Crowder
*Assistant Examiner*—Shirra L. Jenkins
*Attorney, Agent, or Firm*—David L. Baker; Rhodes & Ascolillo

[57] ABSTRACT

A protective swimwear garment for infants and young children who wear diapers. The panty like garment is waterproof and is worn over the diaper. A seal is made between the body and the garment by inflating an air receiving chamber around the waist and legs which will prevent water from entering and soaking the diaper.

3 Claims, 3 Drawing Sheets

INFANT SWIMWEAR WITH INFLATABLE WAIST AND LEG PORTIONS

BACKGROUND OF THE INVENTION

1. Field of the Invention

This invention relates generally to swimwear for infants and young children and more particularly to a garment that will prevent the commingling of water and diaper contents.

2. Description of the Prior Art

Cloth, reusable diapers for infants and small children have now been largely replaced by the combination of a plastic sheet with an absorbent fibrous material that faces the infants body and absorbs the waste products. These diapers are quick, convenient and disposable. In the past, cloth diapers were always accompanied with a water resistant outer panty which was necessary in the event that the cloth diaper became saturated or otherwise unusually soiled. The outer panty included elastic to snug the garment to the body at the three apertures. In general, the concept is not unlike that used with mens' and womens' undergarments today.

The combination of plastic diapers and the increase in the number of homes with back yard pools presents a challenge for the parent to keep the pool water from the diaper, as the fibrous material quickly disintegrates in water, and keeping the soil and the fibrous material out of the pool. The use of elastic material to create a barrier for pool water has been found to be impractical in that the tension required to do the job effectively will, after a time, adversely effect the circulation in the extremities of the infant. In addition, experience shows that the elastic tends to leak in an area proximate the spinal column since the span is long between the hips and the existing panties are designed and constructed to keep the soil and waste in rather than keeping water out.

A number of U.S. Patents attempting to solve the problem of leaking diapers have been granted. The problem of leaking out is not the same as the combined problem of leaking in and leaking out, however the prior art as known to Applicant is as follows: U.S. Pat. No. 3,604,422 issued Sep. 14, 1971 to Sabee for a diaper with a non-leaking side seal; U.S. Pat. No. 3,865,111 issued Feb. 11, 1975 to Brooks for a disposable diaper that incorporates raised ribs to form sealing beads along each lateral edge of diaper; U.S. Pat. No. 4,425,128 issued Jan. 10, 1984 to Motomura for a diaper cover which is both air-permeable and waterproof which is a more or less conventional diaper with non aligned areas for absorption and ventilation; U.S. Pat. No. 4,585,447 issued Apr. 29, 1986 to Karami for a disposable diaper having elasticized crotch and waist seals to minimize leakage out of the diaper, and to the same assignee U.S. Pat. No. 4,643,728 issued Feb. 17, 1987 to Karami another disposable diaper with elasticized waterproof crotch seals.

The prior art fails to show a panty like garment that will withstrand the activity of an infant or small child in a swimming environment without leaking water into the diaper. The garments are all designed to contain the waste and liquids of a child generally at rest but at least sitting, standing or lying. There is no garment known to Applicant that will protect both the child and the pool water as well as the swimwear described and claimed herein.

SUMMARY OF THE INVENTION

This invention is directed to a waterproof garment that will prevent the commingling of infant diaper contents and outside moisture and in particular water as may be found at the beach or in a swimming pool. The panty style garment overfits the diaper on the infant or small child and is worn beneath the swim suit, if one is worn. The waist band and leg openings of the garment contain an expandable tube like, ring shaped member that will retain air under low pressure when inflated. A small mouth piece is part of each ring member and includes a sealing cap. The mouth piece is used to inflate the expandable ring, thus creating a seal between the garment and the body of the infant. In an alternative embodiment the entire undergarment becomes a single inflatable cell that envelops the infants lower torso. The garment is formed of plastic material or of a rubberized waterproof cloth, any one of many types well known to those skilled and experienced in the garment industry.

It is therefore an object of the invention to provide new and improved swim wear for infants and small children that will prevent the water from a pool or other body of water from leaking into the diaper enclosure of an infant or small child.

It is another object of the invention to provide a new and improved means for sealing waterproof garments to the body of an infant.

It is a further object of the invention to provide new and improved swim ware for infants that will protect pool water from contamination from diaper contents.

It is still another object of the invention to provide new and improved swim ware for infants and young children that is low in cost and simple to manufacture.

It is still a further object of the invention to provide new and improved swim ware that is safe and easy to use.

These, together with other objects of the invention, along with the various features of novelty which characterize the invention, are pointed out with particularity in the claims annexed to and forming a part of this disclosure. For a better understanding of the invention, its operating advantageous and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF A PREFERRED EMBODIMENT

Figure 1:
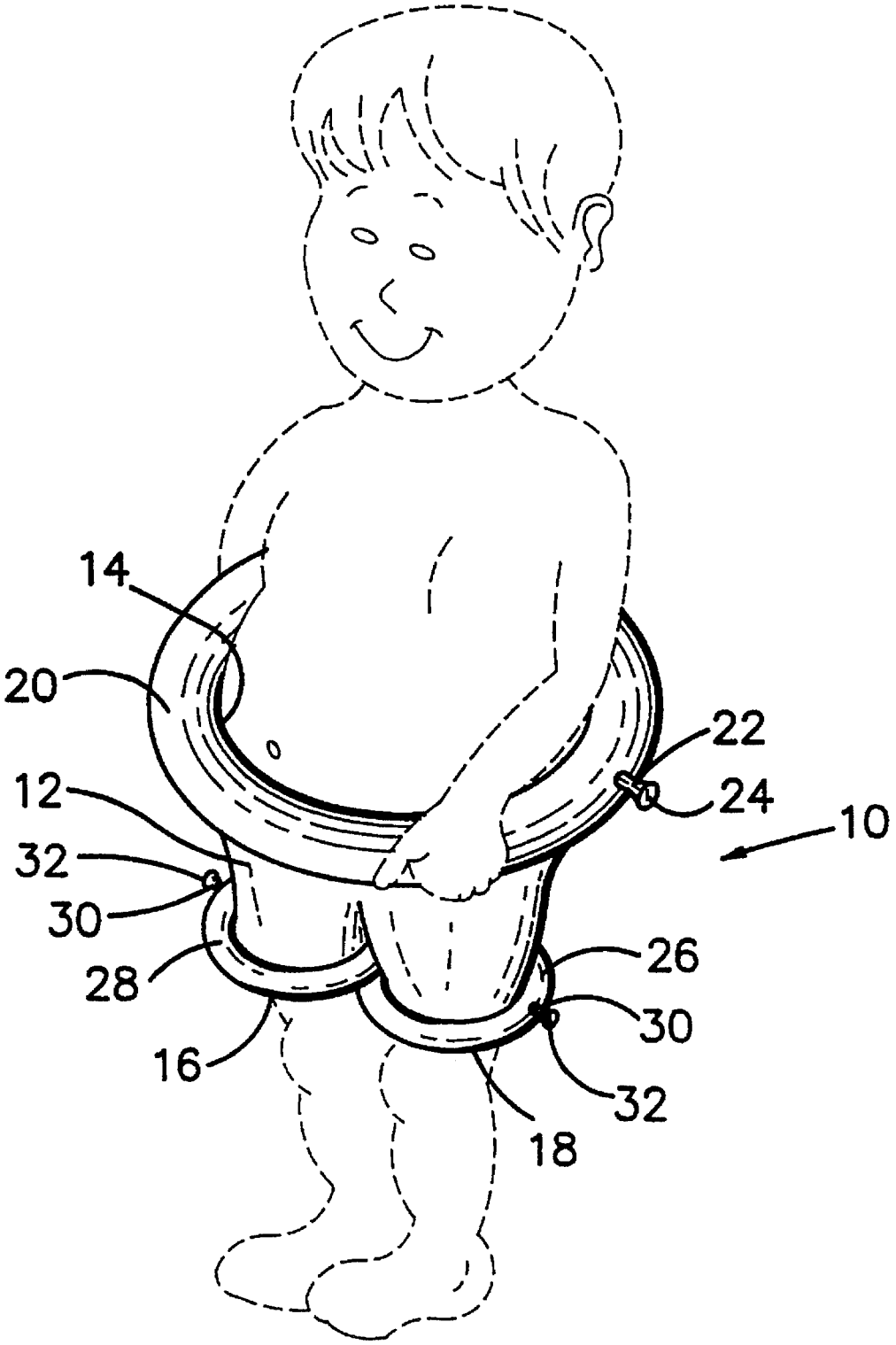
FIG. 1 is an environmental view of the invention.

Referring now to FIG. 1, the protective garment is shown generally at 10 as it would be worn by a young child shown in dash lines. The panties consist of a main torso section 12 having a large aperture 14 at one end to encompass the abdomen of the wearer and two smaller apertures 16 and 18 at the other end to accommodate the legs. A waist band 20 is attached to the garment around the perimeter of the large aperture. The waist band is formed from a hollow ring shaped air receiving chamber and contains a mouth piece 22 with a cap 24. The chamber may be inflated by mouth and sealed with a cap that will hold the air in the chamber, thereby maintaining the water inhibiting seal between the garment and the body of the infant. The leg apertures 16, 18 are also each provided with hollow ring shaped air receiving chambers 26 and 28, which engage the thigh portion of the child. A mouth piece 30 is provided with a sealing cap 32 in order to inflate the air receiving chambers and make the water inhibiting seal between the garment and the legs of the child.

Figure 2:
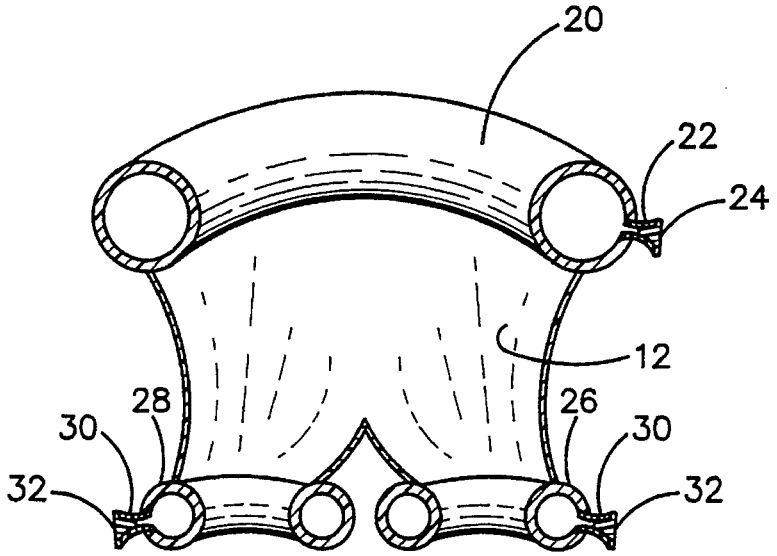
FIG. 2 is a cross sectional view of the invention taken through the vertical mid-section looking at the interior of the seat portion.

Concerning FIG. 2, the panties 12 are of sufficient size to fit over a diaper and connect on one end to the tube like inflatable air receiving chamber 20 which replaces a conventional waist band. The mouth piece 22 is shown communicating with the chamber 20. The cap seal 24 is used to contain the air in the chamber once it has been inflated. Leg apertures are sealed with air receiving chambers 26 and 28 which include communicating mouth pieces 30 and sealing caps 32.

Figure 3:
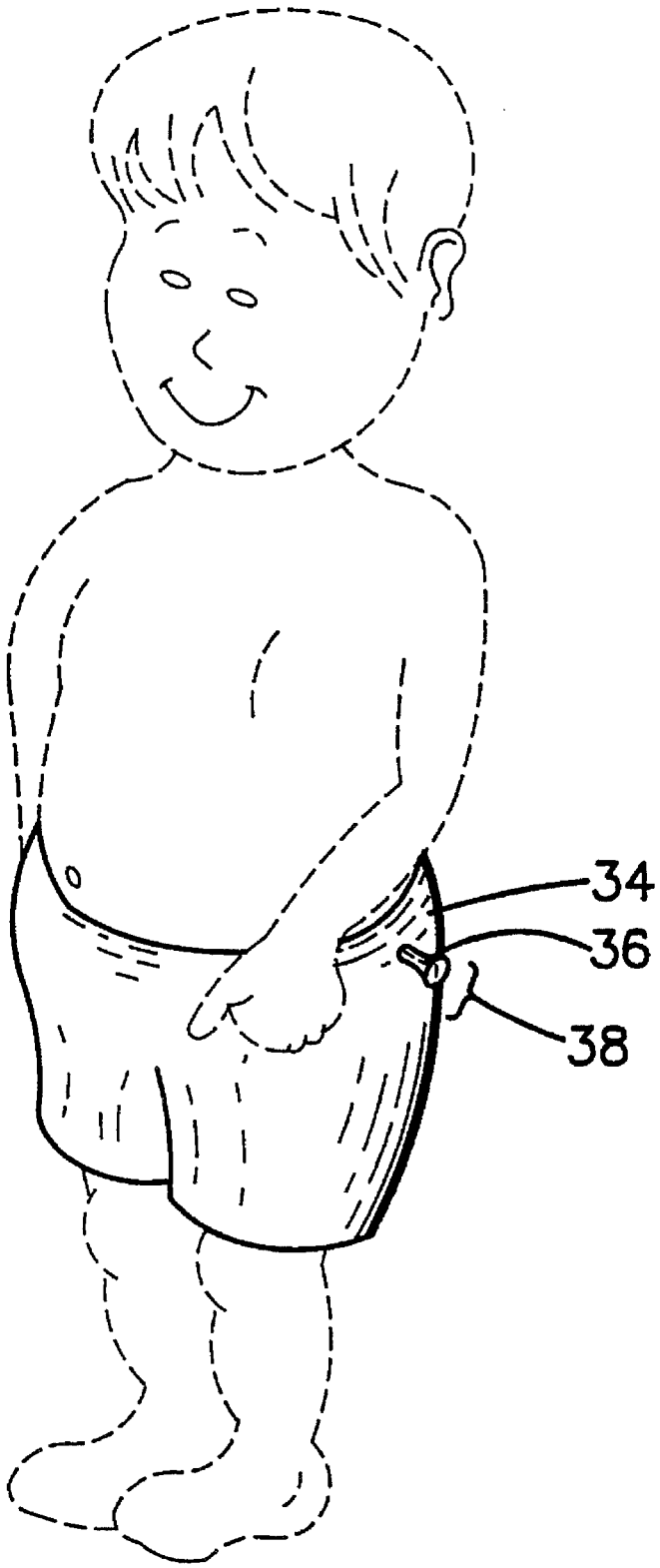
FIG. 3 is an environmental view of an alternative embodiment of the invention.

In FIG. 3 an alternative embodiment is shown wherein the entire panty is inflated and becomes a single cell air receiving chamber. The panty 34 encompasses the lower torso of the infant and upper portion of the thigh and when inflated via mouth piece 36 and cover seal 38 forms a water resistive seal between the body and the panty and thereby protecting the underlying diaper.

Figure 4:
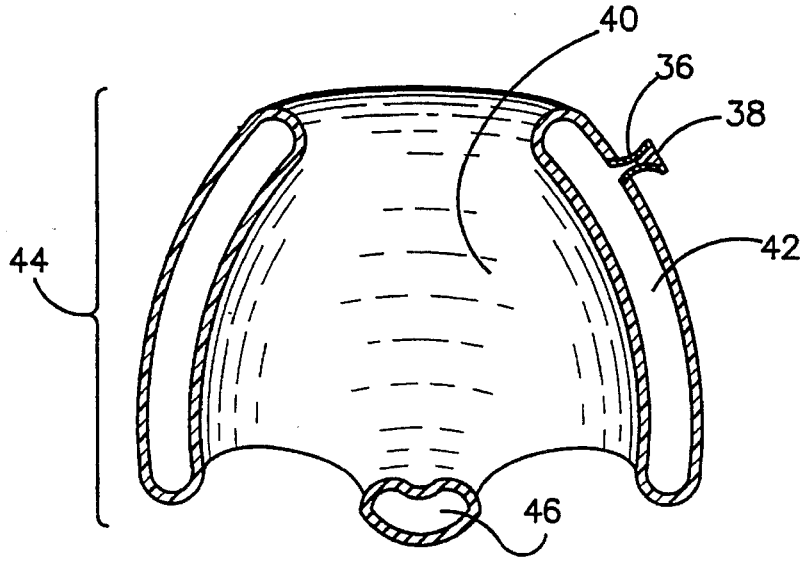
FIG. 4 is a cross sectional view of the invention taken through the vertical mid-section looking at the interior of the seat portion.

Concerning FIG. 4, viewing the interior seat portion of the panty 40, the garment is constructed of a double layer of material forming an air receiving cavity 42 between the layers including the torso and crotch portion 44 and 46. The entire garment is inflated by means of the mouth piece 36 and cover seal 38.

The garments are torso enveloping and completely surround the infant's body from the waist to the thigh and protects that region from water or other fluids while covering a diaper. A swim suit may be worn over the garment if desired. The garment may be formed of a soft plastic material that is waterproof and include the inflatable air receiving chambers. In the alternative, a rubberized fabric may be utilized which would also include the inflatable air receiving chambers.

It should be understood, of course, that the foregoing disclosure relates to only a preferred embodiment of the invention and that numerous modification or alterations may be made therein without departing from the spirit and scope of the invention as set forth in the appended claims.

What is claimed is:

1. A swimwear garment for protecting an infant diaper in a water environment comprising:

a waterproof body garment, adapted to envelop an infant in a diaper, comprising:

a main torso section;

a torso receiving aperture at an end of the main torso section;

apertures for the left and right leg at another end distal the torso receiving aperture;

expandable waist band seal for engaging an infant at mid torso;

said waist band seal comprising;

a hollow air receiving inflatable waist chamber; and a valve for inflating said waist chamber;

expandable leg band seals adapted to engage the mid-thigh of an infant;

each said leg band seal comprising:

a hollow air receiving inflatable leg chamber; and a valve for inflating said leg chamber;

said bands affixed to the perimeter of the main torso section whereby water will be inhibited from entering the apertures and causing a diaper to become wet.

2. A swimwear garment according to claim 1 wherein the body garment is flexible plastic material.

3. A swimwear garment according to claim 1 wherein the body garment is a rubberized fabric material.

* * * * *